US005263348A

United States Patent [19]

Wittwer

[11] Patent Number: 5,263,348

[45] Date of Patent: Nov. 23, 1993

[54] CYLINDER LOCK

[75] Inventor: Reinhard Wittwer, Heiligenhaus, Fed. Rep. of Germany

[73] Assignee: Hülsbeck & Fürst GmbH & Co. KG, Velbert, Fed. Rep. of Germany

[21] Appl. No.: 897,995

[22] Filed: Jun. 16, 1992

[30] Foreign Application Priority Data

Jul. 6, 1991 [DE] Fed. Rep. of Germany ..... 4122414

[51] Int. Cl.[5] ..... E05B 65/00

[52] U.S. Cl. ..... 70/379 R; 70/223; 70/360; 70/422

[58] Field of Search ..... 70/379 R, 380, 492, 70/491, 419, 422, 358, 379 A, 36 D, 222, 223

[56] References Cited

U.S. PATENT DOCUMENTS

| | | | |
|---|---|---|---|
| 4,369,642 | 1/1983 | Grell | 70/380 |
| 4,385,510 | 5/1983 | Harper | 70/492 |
| 4,903,512 | 2/1990 | Leroy et al. | 70/380 |
| 5,070,716 | 12/1991 | Whorlow | 70/492 |

FOREIGN PATENT DOCUMENTS

| | | | |
|---|---|---|---|
| 0139550 | 5/1985 | European Pat. Off. . | |
| 3827418 | 2/1990 | Fed. Rep. of Germany . | |
| 1046542 | 12/1953 | France . | |
| 2005335 | 4/1979 | United Kingdom | 70/379 R |
| 2228523 | 8/1990 | United Kingdom | 70/379 R |
| 8002857 | 12/1980 | World Int. Prop. O. | 70/491 |

*Primary Examiner*—Peter M. Cuomo
*Assistant Examiner*—Darnell M. Boucher
*Attorney, Agent, or Firm*—Peter K. Kontler

[57] ABSTRACT

A cylinder lock for use in motor vehicles and elsewhere has a case for a rotatable and axially movable sleeve-like guide which receives a rotatable cylinder having a keyhole and being locked to the guide by tumblers when the key is withdrawn. A detent is installed between the case and the guide to normally prevent rotation of the guide except when the guide is acted upon by a large force which causes it to deactivate the detent as a result of certain axial movement of the guide and cylinder in the case. A clutch between the cylinder and a motion transmitting element for a bolt of the lock is engaged as long as the detent is operative but is disengaged not later than when the detent permits the guide to turn in the case. If the cylinder is rotated by an implement other than a fitting key, and the implement applies the large force, the detent is deactivated as a result of axial movement of the guide and cylinder relative to the case whereby the clutch is disengaged and the cylinder cannot turn the motion transmitting element and the locking bolt. The detent has one or more projections in an end face of the guide one or more complementary sockets in an end face of the case, and a spring which biases the end face of the guide toward the end face of the case.

18 Claims, 3 Drawing Sheets

CYLINDER LOCK

BACKGROUND OF THE INVENTION

The invention relates to locking devices in general, and more particularly to improvements in cylinder locks. Still more particularly, the invention relates to improvements in cylinder locks of the type which can be put to use in motor vehicles, for example, to lock a hood, a door or a glove compartment.

It is already known to provide a cylinder lock with a cylinder having a keyhole and being rotatable in a tubular guide which, in turn, is installed in a case or housing. When the key is withdrawn from the keyhole, the cylinder is automatically locked so that it cannot rotate relative to the guide due to the provision of spring-biased tumblers which release the cylinder for rotation with reference to the guide only in response to proper insertion of a fitting key, i.e., when an authorized person possessing a proper key seeks to open the lock. The cylinder is free to turn relative to the case in response to the application of pronounced torque which suffices to disengage a detent mechanism between the case and the guide. The disengagement of such detent mechanism involves an axial movement of the guide and of the cylinder therein through a distance which suffices to result in expulsion or extraction of a male detent member from a female detent member. The cylinder is normally coupled to a motion transmitting element, e.g., an element which can pivot and/or otherwise move one or more locking bolts between operative and inoperative positions. However, the torque transmitting connection between the motion transmitting element and the cylinder is interrupted when the detent mechanism is inactive. Thus, if an unauthorized person who does not own a fitting key succeeds in rotating the cylinder about its axis, this can take place only by rotating the guide with the cylinder, i.e., subsequent to disengagement of the detent mechanism. Consequently, such rotation of the cylinder with the guide cannot result in opening of the lock because the torque transmitting connection between the cylinder and the motion transmitting element is interrupted when the detent mechanism is deactivated. The tumblers permit the cylinder to turn relative to the guide (and to thus transmit torque to the motion transmitting element) only when the detent mechanism is operative, i.e., the cylinder can turn in the guide and can transmit torque to the motion transmitting element only when the tumblers are moved to inoperative positions by a fitting key which must be properly introduced into the keyhole of the cylinder.

A cylinder lock of the above outlined character is disclosed in published German patent application No. 38 27 418. The cylinder lock of this German application comprises a detent mechanism forming part of an axial clutch which normally couples the cylinder to the motion transmitting element and includes an axially movable clutch portion which is axially movably but non-rotatably carried by the cylinder and is biased axially of the cylinder by a spring of the detent mechanism to normally engage an axially fixed clutch element which can transmit torque to the motion transmitting element. A drawback of such lock is that its space requirements are quite pronounced. This holds especially true for the overall length of the lock, as seen in the axial direction of the cylinder. In fact, the length of the lock between the torque transmitting connection (such connection embodies the detent mechanism) and the motion transmitting element almost matches the length of the assembly including the cylinder and its guide. Moreover, the just described cylinder lock comprises a large number of parts.

European Pat. No. 0 139 550 discloses a cylinder lock which also comprises a tubular guide for a cylinder. The cylinder has a keyhole and is normally non-rotatably locked to the guide by a set of tumblers except when the keyhole receives a fitting key. The guide is installed in the case and is held against rotation relative to the case by a detent mechanism having a socket in the peripheral surface of the guide and a spring-biased ball which is mounted in the case and is receivable in the socket to hold the guide against rotation in the case. The ball must be expelled from the socket, by moving radially of the guide, in order to permit rotation of the guide in the socket. The guide further comprises an axially extending projection which cooperates with a reciprocable coupling member. When the cylinder of this lock is rotated by a properly inserted fitting key, the reciprocable member moves away from the projection of the guide so that the coupling can establish a torque transmitting connection between the cylinder and a motion transmitting element which initiates the actual locking or unlocking operation. If a burglar or another unauthorized person attempts to forcibly turn the cylinder with an implement other than a fitting key, the guide rotates with the cylinder because the detent mechanism is disengaged. Consequently, the projection of the guide remains in the path of movement of the reciprocable pusher and prevents the latter from establishing a torque transmitting connection between the cylinder and the motion transmitting element, i.e., between the cylinder and that part or those parts which must be rotated or otherwise moved in order to open the lock. Thus, the fact that an unauthorized person suceeds in turning the cylinder with an implement other than a fitting key entails rotation of the guide for the cylinder but not the establishment of a proper connection between the cylinder and the motion transmitting element. Moreover, the aforementioned reciprocable pusher of the connection between the cylinder and the motion transmitting element is not affected by a shifting of the ball forming part of the detent mechanism between the guide and the case when the cylinder is rotated by an implement other than a fitting key, e.g., by a burglar's tool.

French Pat. No. 1.046.542 discloses a cylinder lock wherein a split guide for the cylinder includes a first portion with three pairs of pin-shaped tumblers and a second portion with two pairs of pin-shaped tumblers. The first portion of the guide must be rigidly secured to and installed in a door or the like, and the second portion has limited freedom of angular movement relative to the first portion. A detent mechanism is provided to normally prevent rotation of the second portion of the composite guide relative to the first portion, and such detent mechanism acts in the axial direction of the cylinder and its guide. When the detent mechanism is disengaged or deactivated as a result of axial movement of at least one of its parts, the second portion of the guide can turn relative to the first portion; however, a coupling between the cylinder and a motion transmitting element is then disengaged as a result of deactivation of the detent mechanism. A fitting key can be used to rotate the cylinder relative to both portions of the guide, and such rotation entails a corresponding movement of the motion transmitting element because the coupling is engaged. If an unauthorized person uses a burglar's tool or another implement to forcibly rotate the cylinder, the latter can be rotated relative to the first portion of the guide in response to exertion of a rather substantial force. This results in destruction of the pin-shaped tumblers in the first portion of the guide. The torque transmitting connection between the cylinder and the second portion of the guide continues to exist so that further rotation of the cylinder (relative to the first portion of the guide) entails rotation of the second portion relative to the first portion whereby the detent mechanism between the two portions of the guide is deactivated. This, in turn, results in disengagement of the coupling between the cylinder and the motion transmitting element, i.e., the latter cannot be rotated by the rotating cylinder. A drawback of the just discussed patented cylinder lock is that the two-piece guide must be replaced with a fresh (intact) guide after each attempt to open the lock with an implement other than a fitting key. The reason is that the pin-shaped tumblers of the first portion of the guide are destroyed when the cylinder is rotated relative to such portion with a tool other than a fitting key.

OBJECTS OF THE INVENTION

An object of the invention is to provide a simple, compact and inexpensive cylinder lock.

Another object of the invention is to provide a novel and improved detent mechanism for use between the guide for the cylinder and the case or housing of a cylinder lock.

A further object of the invention is to provide a lock which is constructed and assembled in such a way that none of its parts must be damaged or destroyed in response to unauthorized attempts to rotate the cylinder by an implement other than a fitting key.

An additional object of the invention is to provide a cylinder lock which comprises a small number of component parts but can still perform all functions of the aforediscussed conventional locks.

Still another object of the invention is to provide a novel and improved case for use in the above outlined cylinder lock.

A further object of the invention is to provide a cylinder lock which is more compact than, but just as effective as, heretofore known cylinder locks.

Another object of the invention is to provide a novel and improved combination of a tubular guide for the cylinder and a case for the guide in a cylinder lock of the above outlined character.

An additional object of the invention is to provide a novel and improved clutch between the cylinder and the motion transmitting member for use in a cylinder lock of the above outlined character.

Still another object of the invention is to provide a cylinder lock which embodies the above outlined features and can be utilized with particular advantage in motor vehicles to ensure safe locking of hoods, trunks, doors, compartments, fuel tank caps and/or other parts.

A further object of the invention is to provide the above outlined cylinder lock with a simple and inexpensive torque transmitting connection between the cylinder and that element or those elements which are called upon to actually perform a closing or opening operation.

An additional object of the invention is to provide a novel and improved cylinder lock which can be installed in motor vehicles and/or elsewhere as a superior substitute for heretofore known cylinder locks.

SUMMARY OF THE INVENTION

The invention is embodied in a lock which can be utilized with advantage in motor vehicles and comprises a case or housing having a first face, a tubular guide member axially movably and rotatably mounted in the case and having a second face which confronts the first face, a cylinder member which is rotatably mounted in the guide member and has a keyhole, and at least one tumbler which is movably mounted in one of the members and normally engages the other member to prevent rotation of the cylinder member in the guide member. The at least one tumbler is disengaged from the other member in response to insertion of a fitting key into the keyhole so that the inserted fitting key can be used to rotate the cylinder member in the guide member. The lock further comprises a detent including at least one projection on one of the faces, at least one socket provided in the other face and means for biasing the at least one projection into the at least one socket axially of the guide member to thereby prevent rotation of the guide member in the case. The at least one projection is expelled from the at least one socket in response to the application to the guide member of a torque which is sufficient to turn the guide member with attendant axial movement of the guide member from a first position, through a predetermined distance away from the first face and against the opposition of the biasing means, to a second position. The lock further comprises a motion transmitting element which is rotatably mounted in or on the case (i.e., which is rotatably carried by the case), and means for rotating the motion transmitting element in response to rotation of the cylinder member by a properly inserted fitting key in the first position but not in the second position of the guide member. Thus, the motion transmitting element can be rotated by a key or by any other implement only when the detent is operative to prevent the guide member from rotating with the cylinder member relative to the case.

The motion transmitting element and/or the case is provided with means for maintaining such element in a predetermined axial position relative to the case, and the lock can further comprise means (e.g., one or more springs) for yieldably urging the at least one tumbler into engagement with the other member. The motion transmitting element can be mounted in such a way that it is coaxial with the cylinder member and with the guide member. The first face can include an annular internal shoulder of the case, and the second face can include an annular external shoulder on the guide member. These shoulders can be disposed in planes which are at least substantially normal to the common axis of the motion transmitting element, guide member and cylinder member.

The lock can further comprise means (e.g., an internal abutment or stop of the case) for limiting the extent of axial movability of the cylinder member and guide member away from the first face.

The rotating means can comprise a clutch having a first portion provided directly on the motion transmitting element and a second portion provided directly on the cylinder member and non-rotatably engaging the first portion in the first position of the guide member, i.e., when the detent is operative to prevent rotation of the guide member relative to the case.

In accordance with a presently preferred embodiment, the guide member comprises an external collar and the case has an internal surface provided with a substantially cylindrical recess for the collar. The first face can be provided in the recess, and the second face can be provided on the collar. The at least one projection can be provided on the collar, i.e., the at least one socket is then provided in the first face. The biasing means can be provided in the recess of the case and can include at least one resilient element which reacts against the case and bears against the collar. Such at least one resilient element can include or constitute a coil spring engaging the collar, namely that side of the collar which is located opposite the second face and faces away from the first face. The first face can be disposed at one axial end of the recess, and the coil spring can react against the case at the other axial end of the recess. In other words, a first axial end of the recess can be located at, and a second axial end of the recess can be remote from, the first face.

The rear end of the case can be disposed in closer proximity to the first face than the front end of the case. Alternatively, the rear end of the case can be more distant from the first face than the front end.

The face which is provided with the at least one socket is preferably formed with two ramps which are inclined relative to the axis of the guide member and flank the at least one socket. The at least one projection of the detent in such lock has two follower surfaces which are adjacent the ramps in the first position of the guide member and one of which slides along the respective ramp or vice versa in response to the application of torque which suffices to compel the guide member and the cylinder member to move axially and away from the first face.

One of the first and second clutch portions is a male clutch portion and the other clutch portion is a female clutch portion. The male clutch portion has an at least partially non-circular cross-sectional outline, and the female clutch portion is complementary to the male portion. One of these clutch portions is rotatable with the cylinder member, and the other clutch portion is rotatable with the motion transmitting element. The motion transmitting element has a surface which confronts the cylinder member, and the female clutch portion can include or constitute a socket in the surface of the motion transmitting element. Alternatively, the female clutch portion can include a through passage in the motion transmitting element; the male clutch portion of the rotating means including such passage can comprise a shank which is rigid with the cylinder member and extends into the passage of the motion transmitting element, at least in the first position of the guide member.

The novel features which are considered as characteristic of the invention are set forth in particular in the appended claims. The improved cylinder lock itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
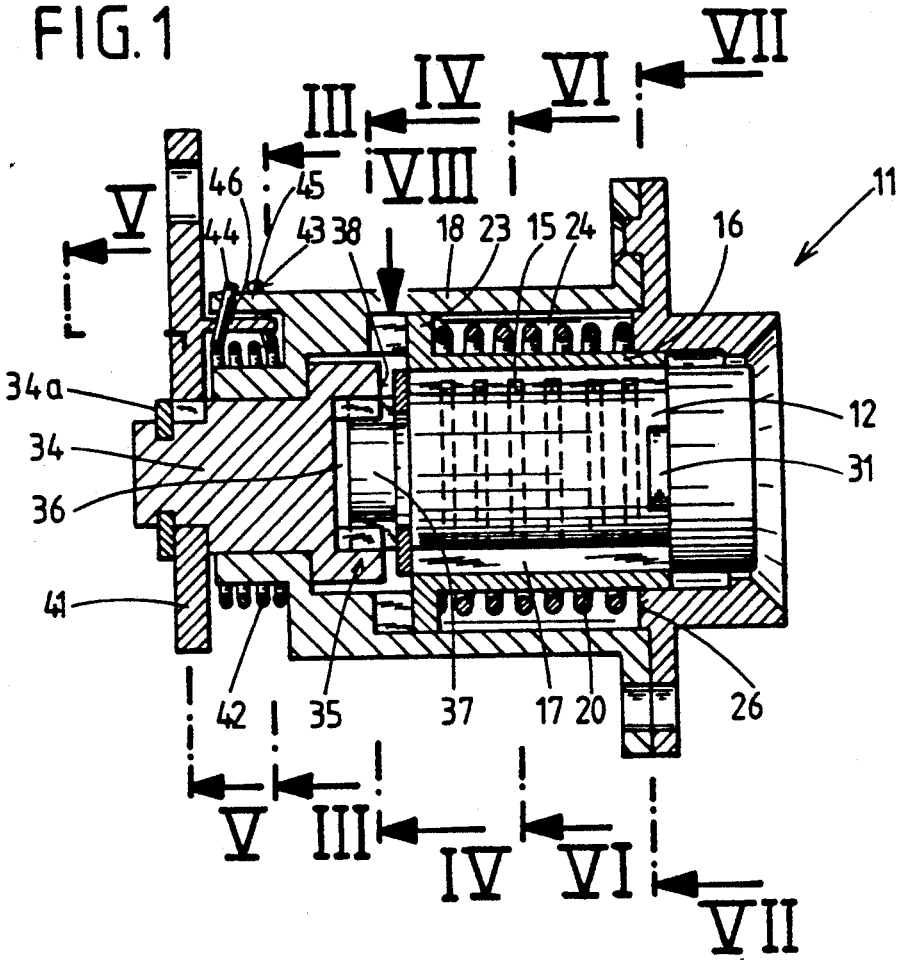
FIG.1 is an axial sectional view of a cylinder lock which embodies one form of the invention, the guide and the cylinder of the lock being shown in their first positions in which the detent is operative and the clutch is engaged.

The cylinder lock 11 which is shown in FIGS. 1 to 9 comprises a rotary cylinder 12 having a substantially axially extending keyhole 13 (FIG. 6) for a fitting key 14. The cylinder 12 is normally non-rotatably locked to a sleeve-like tubular guide 16 by a set of spring-biased tumblers 15. The arrangement is such that, when a fitting key 14 is properly inserted into the keyhole 13, such key displaces the spring-biased tumblers 15 (the tumblers are pivoted and/or otherwise moved between the positions of FIG. 1—in which the cylinder 12 is non-rotatably locked to the guide 16—and the positions of FIG. 2 in which the cylinder 12 is free to turn in the guide 16 in response to turning of the key 14). In the lock 11 of FIGS. 1 to 9, the tumblers 15 are reciprocably mounted in the cylinder 12 (see FIG. 6) and normally extend, with requisite play, into adjacent recesses or grooves 17 of the guide 16. The establishment of some lateral play between the surfaces flanking the recesses 17 and the respective tumblers 15 facilitates penetration of the tumblers into and their extraction or expulsion from the respective recesses. Each tumbler 15 is biased by at least one spring 15*a* (FIG. 6) in response to proper insertion of a fitting key 14 into the keyhole 13.

Figure 8:
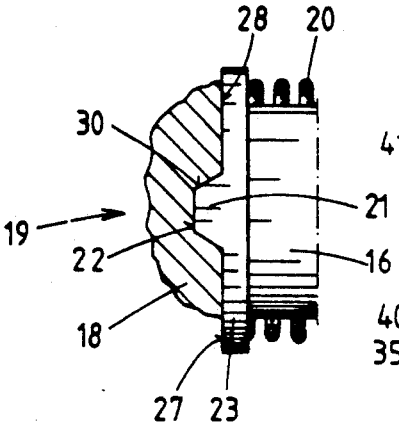
FIG. 8 is a fragmentary side elevational view of the detent in operative position, substantially as seen in the direction of arrow VIII in FIG. 1.
Figure 9:
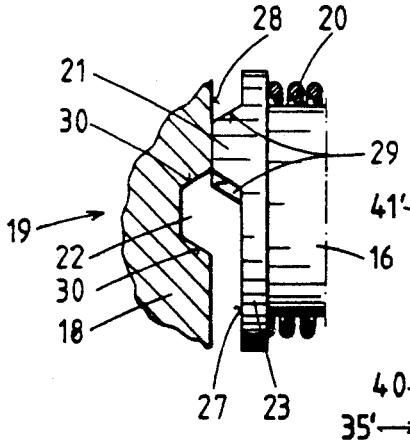
FIG. 9 is a similar fragmentary side elevational view but showing the detent in the inoperative position substantially as seen in the direction of arrow IX in FIG. 2.

The guide 16 resembles an elongated sleeve which is rotatably installed in a composite housing or case 18 of the cylinder lock 11. However, when the lock 11 is not tampered with by a burglar or another unauthorized person, the guide 16 is held against rotation relative to the case 18 by a detent mechanism 19 (hereinafter called detent for short) which is best shown in FIGS. 8 and 9 and is constructed and installed in accordance with a feature of the present invention. The detent 19 acts not unlike an overload clutch which is automatically deactivated (but not destroyed) to permit rotation of the guide 16 relative to the case 18 in response to the application of a pronounced torsional stress to the cylinder 12 while the latter is non-rotatably coupled to, the guide 16 by the tumblers 15, i.e., if the cylinder 12 is rotated by an implement other than a properly inserted fitting key 14 in the keyhole 13. The case 18 is riveted and/or otherwise reliably secured to a hood, a door, a pivotable panel of a glove compartment, a fuel tank cap or any other part which is to be releasably locked in response to rotation of the cylinder 12 relative to the guide 16.

Figure 4:
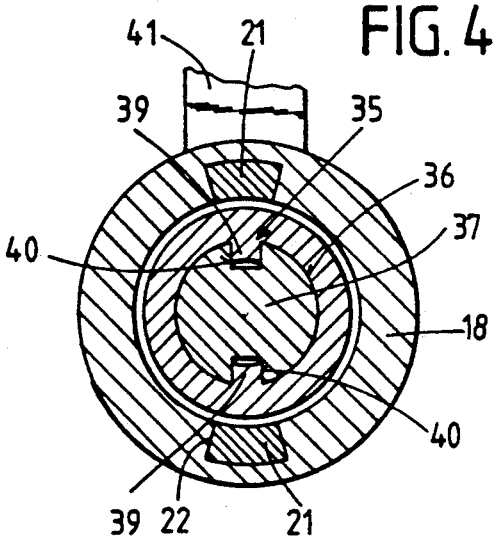
FIG. 4 is a transverse sectional view substantially as seen the direction of arrows from the line IV—IV in FIG. 1.

The illustrated detent 19 comprises at least one male detent portion 21 in the form of a projection (see particularly FIGS. 4, 8 and 9) provided on an annular external shoulder or face 27 at the rear side of a ring-shaped external collar 23 forming part of the guide 16. Furthermore, the detent 19 comprises at least one female detent portion having a socket 22 which is complementary to the projection 21 and is provided in an annular internal shoulder or face 28 of the case 18. Still further, the detent 19 comprises means for yieldably biasing each projection 21 into a socket 22 (FIG. 8) with a predetermined force which must be overcome before the detent 19 is deactivated in that the top land of each projection 21 is free to slide along the face 28 of the case 18 (FIG. 9). The illustrated biasing means comprises at least one resilient element here shown as a coil spring 20 bearing against that side of the collar 23 which is located opposite the face 27 and faces away from the face 28 to react against an internal collar or end face 26 in a cylindrical recess 24 provided in the internal surface 25 of the case 18. FIG. 4 shows that the case 18 can be provided with two sockets 22 which are disposed diametrically opposite each other and each of which can receive, and can be at least substantially filled by, a discrete projection 21. The faces 27 and 28 are located in planes which are normal to the axis of the cylinder 12.

Figure 2:
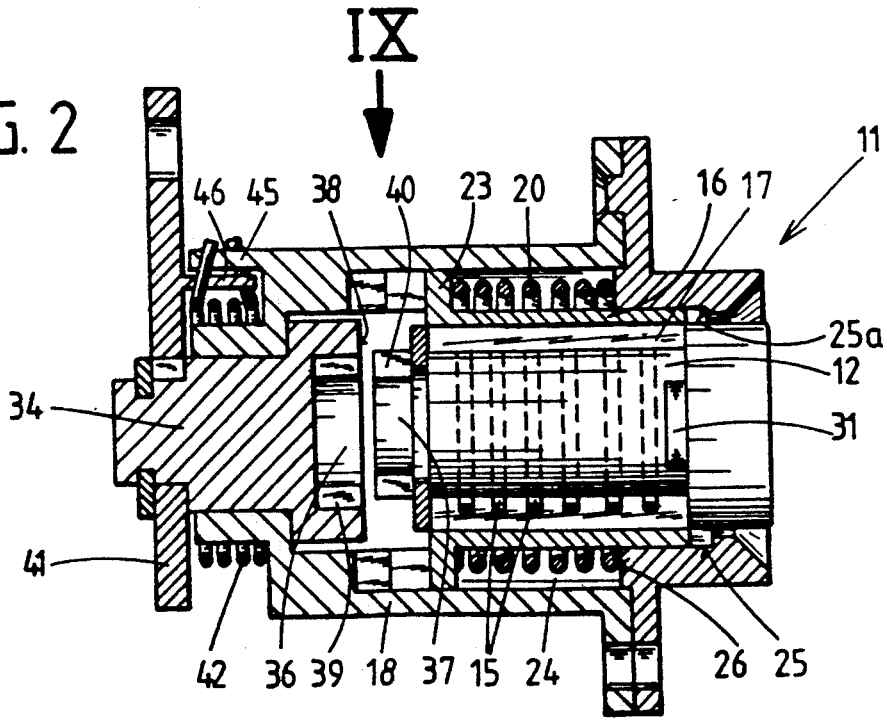
FIG. 2 shows the structure of FIG. 1, but with the cylinder and guide in their second position in which the detent is inoperative and the clutch is disengaged.

In order to permit expulsion of the projections 21 from their sockets 22, the guide 16 has limited freedom of axial movement in the case 18, namely between a first or operative position of FIG. 1 (in which the guide 16 is held by the spring 20) and a second or inoperative position of FIG. 2 (in which the detent 19 is ineffective and the guide 16 can turn in the case 18). The extent of movability of the guide 16 in a direction to the left (as viewed in FIG. 2) is determined by the faces 27, 28 which abut each other or are at least close to each other when each of the projections 21 is received in one of the sockets 22 in a manner as shown in FIG. 8. The extent of movability of the guide 16 in a direction to the right, again as viewed in FIG. 1, is determined by an internal shoulder **25*a* provided in the case 18 and being engaged by the adjacent front end face of the guide 16 when the latter reaches or moves slightly beyond the second position of FIG. 2. The depth of the cylindrical recess 24 (as measured in the radial direction of the guide 16 and case 18) is sufficient to accommodate the collar 23 of the guide, and this recess further serves to confine the spring 20 of the detent 19**.

In the embodiment of FIGS. 1 to 9, the collar 23 is provided at the rear end of the case 18. Thus, the rear end of the case 18 is nearer to the collar 23 than to the front end of the guide 16. The projections 21 are formed directly on the collar 23, and the sockets 22 are provided directly in the (face 28 of the) case 18. The face 28 constitutes a shoulder at the rear axial end of the recess 24, and the internal shoulder or end face 26 at the front axial end of the recess 24 is engaged by the adjacent foremost convolution of the spring 20.

FIGS. 8 and 9 show that each socket 22 is flanked by two ramps 30 which are inclined relative to the axis of the guide 16 and are adjacent complementary follower surfaces 29 of the respective projections 21 when the projections are properly received in the adjacent sockets. Each projection 21 and each socket 22 can be said to have a substantially trapezoidal cross-sectional outline. The inclination of the ramps 30 and follower surfaces 29, together with the bias of the spring 20, determines the magnitude of torque which must be applied to the guide 16 (by the cylinder 12 while the cylinder is non-rotatably connected to the guide 16 by the tumblers 15) in order to expel the projections 21 from their respective sockets 22 (FIG. 9) and to thus permit the guide 16 to turn relative to the case 18.

If an unauthorized person (e.g., a burglar) employs an implement other than a fitting key 14 for the purpose of rotating the cylinder 12 about its axis (which is common to the guide 16), the tumblers 15 prevent rotation of the cylinder relative to the guide 16. This holds true irrespective of whether the unauthorized person seeks to turn the cylinder 12 in a clockwise direction or in a counter-clockwise direction. Once the cylinder 12 is acted upon by a force which suffices to cause one of the two follower surfaces 29 on each projection 21 to slide along the adjacent ramp 30 in the respective socket 22, the guide 16 begins to move axially and away from the face 28 and performs a relatively small angular movement as determined by the inclination of the ramps 30 and follower surfaces 29 relative to the axis of the cylinder 12. The spring 20 is caused to store energy while the cylinder 12 and the guide 16 move as a unit toward the front end of the case 18, namely toward the internal surface **25*a* of the case. When the guide 16 reaches the (second) axial position of FIG. 2, the detent 19 is no longer active so that the unauthorized person is free to turn the guide 16 and the cylinder 12 therein relative to the case 18**.

The magnitude of torque which is required to expel the projections 21 from their sockets 22 in response to rotation of the guide 16 by the cylinder 12 (by an implement which has been introduced into the keyhole 13 in lieu of a fitting key 14) can be readily selected in such a way that it is rather pronounced but does not suffice to cause lasting deformation of and/or any other damage to any part or parts (such as the tumblers 15) of the lock 11.

Once the detent 19 is no longer operative to lock the guide 16 against rotation in the case 18, the top lands of the projections 21 are free to slide along the face 28 in response to the application of a torque which suffices to overcome friction between the projections 21 and the face 28, i.e., to overcome the force with which the stressed spring 20 biases the projections 21 against the adjacent portions of the case 18. Rotation of the guide 16 and cylinder 12 relative to the case 18 can continue until each of the projections 21 again snaps into one of the two sockets 22 under the bias of the coil spring 20. Of course, the unauthorized person can interrupt the application of torque to the cylinder 12 (in order to turn the guide 16 in the case 18) in an angular position of the guide in which the top lands of the projections 21 abut the adjacent portions of the face 28, i.e., in an angular position in which the spring 20 is caused to store a substantial amount of energy.

An authorized person can thereupon reengage or reactivate the detent 19 by using a fitting key 14. The properly inserted fitting key 14 disengages the tumblers 15 from the guide 16 (see FIG. 6) so that the cylinder 12 can turn relative to the guide until a radially outwardly extending lobe 31 (FIG. 7) of the cylinder engages one of two radially extending stop faces 33 in an arcuate cutout 32 machined into or otherwise formed in the internal surface of the tubular guide 16. Once the lobe 31 engages one of the stops 33, the guide 16 is compelled to rotate with the cylinder 12 until the projections 21 snap into the adjacent sockets 22 under the action of the coil spring 20 so that the detent 19 is again operative in that it prevents the guide 16 from rotating relative to the case 18.

Figure 7:
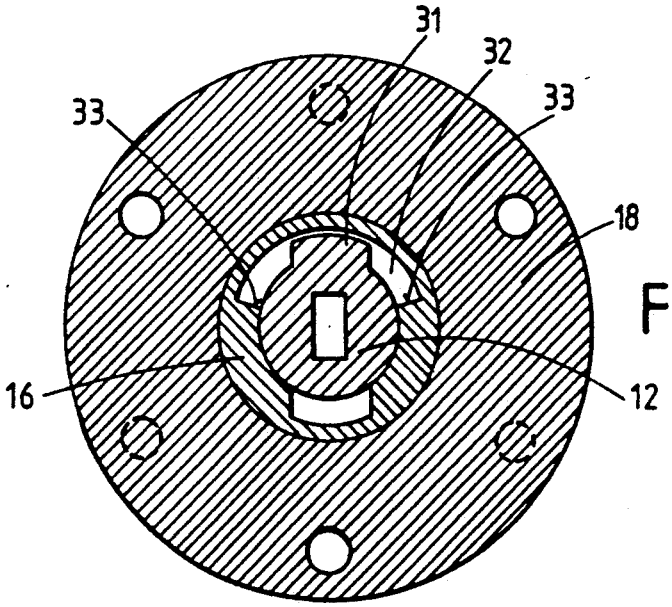
FIG. 7 is a transverse sectional view substantially as seen in the direction of arrows from the line VII—VII in FIG. 1.

FIG. 7 shows the cylinder 12 in a central or neutral angular position in which its lobe 31 is disposed substantially or exactly midway between the stops 33. The length of the cutout 32 in the internal surface of the guide 16 can be selected in such a way that the cylinder 12 can turn from the neutral position clockwise or counterclockwise through an angle of approximately 40° before its lobe 31 reaches and is arrested by one of the stops 33. Once the spring 20 has caused the projections 21 to snap into the adjacent sockets 22 (e.g., in response to rotation of the guide 16 by the cylinder 12 subsequent to engagement of one of the stops 33 by the lobe 31), the operative condition of the lock 11 is restored in that the detent 19 again locks the guide 16 against rotation relative to the case 18. The key 14 is then ready to be used to turn the cylinder 12 in the guide 16 in a direction to move the lobe 31 away from the adjacent stop 33.

Figure 5:
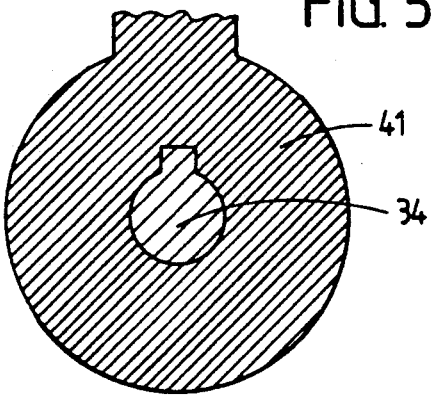
FIG. 5 is a transverse sectional view substantially as seen in the direction of arrows from the line V—V in FIG. 1.
Figure 6:
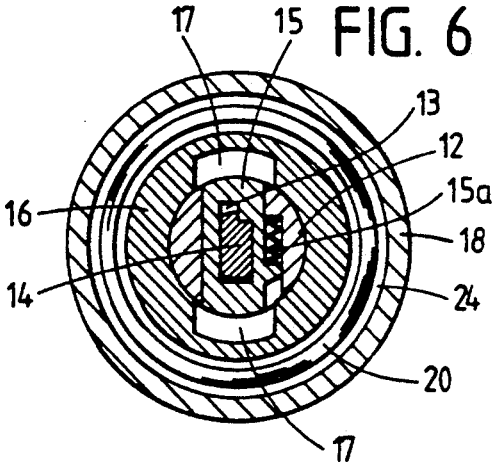
FIG. 6 is a transverse sectional view substantially as seen in the direction of arrows from the line VI—VI in FIG. 1.

The rear portion of the case 18 is taken up by a rotary motion transmitting element 34 which is coaxial with the cylinder 12 and is connected with a locking bolt 41 serving as a means for actually opening or closing the lock 11. The means for rotating the element 34 in response to rotation of the cylinder 12 comprises a clutch 35 which is engaged in the first position but is disengaged in the second position of the guide 16. The clutch 35 comprises a male clutch portion 37 which is provided at the rear axial end of the cylinder 12 and has a non-circular cross-sectional outline (see FIG. 4), and a complementary female clutch portion 36 having a depression or socket for the male clutch portion 37. When the male portion 37 of the clutch 35 extends into the female portion 36, the clutch establishes a form-locking torque transmitting connection between the cylinder 12 and the element 34. The latter is non-rotatably connected with the locking bolt 41 in a manner as shown in FIG. 5. A split ring 34*a* is provided to maintain the element 34 in a predetermined axial position relative to the case 18. The depression or socket of the female clutch portion 36 is provided in that surface (38) of the element 34 which faces the adjacent rear axial end of the cylinder 12. The cross-sectional outline of the clutch element 37 can depart from that which is shown in FIG. 4 in a number of ways without departing from the spirit of the invention. All that counts is to ensure that a torque transmitting connection between the cylinder 12 and the element 34 (and hence the bolt 41) can be established and terminated in response to axial movement of the cylinder 12 between the first position of FIG. 1 (clutch 35 engaged) and the second position of FIG. 2 (clutch disengaged).

The illustrated male clutch portion 37 is essentially a cylindrical stub whose peripheral surface is provided with two axially parallel grooves 40 disposed diametrically opposite each other. These grooves serve to receive axially parallel ribs 39 which are provided on the element 34 in the depression or socket of the female clutch portion 36. When the grooves 40 receive the ribs 39, an authorized person having at her or his disposal a fitting key 14 can rotate the cylinder 12 relative to the guide 16 and case 18 whereby the cylinder 12 causes the clutch 35 to turn the motion transmitting element 34 which pivots the bolt 41 in a direction to open or close the lock 11.

Figure 3:
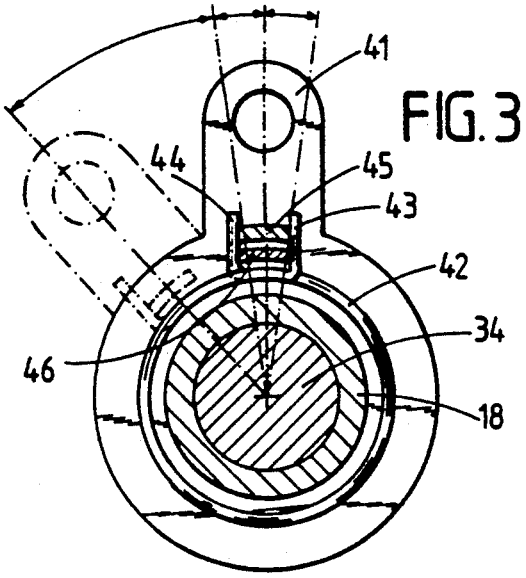
FIG. 3 is a transverse sectional view substantially as seen direction of arrows from the line III—III in FIG. 1.

The illustrated lock 11 preferably further comprises a torsion spring 42 having a first end portion 43 reacting against an axially parallel protuberance 45 of the case 18, and a second end portion 44 engaging an axially extending protuberance 46 of the bolt 41 and tending to maintain the bolt in a selected angular position. The movement which the spring 42 imparts to the bolt 41 is transmitted to the element 34 and through the engaged clutch 35 to the cylinder 12 so that the cylinder maintains its keyhole 13 in a predetermined orientation preferably corresponding to that starting angular position of the bolt 41 in which the latter maintains the lock 11 in closed position. As shown in FIG. 3, the torsion spring 42 in the lock of FIGS. 1 to 9 is designed to pivot the bolt 41 from the phantom-line position to the solid-line position.

The axial distance between the first (FIG. 1) and second (FIG. 2) positions of the male clutch portion 37 is selected in such a way that the male clutch portion 37 is invariably extracted from the depression or socket of the female clutch portion 36 when the detent 19 is inactive, i.e., when the guide 16 is free to turn relative to the case 18. This ensures that an unauthorized person is unable to turn the bolt 41 in a direction to open the lock 11, even if such person has succeeded in turning the cylinder 12 with a force and to an extent necessary to deactivate the detent 19. At such time, the cylinder 12 turns with the guide 16 relative to the case 18 but the clutch 35 is disengaged so that rotation of the cylinder does not result in rotation of the motion transmitting element 34 and bolt 41. The spring 20 is then maintained in stressed condition because the projections 23 of the detent 19 are expelled from their sockets 22; this, in turn, ensures that the male clutch portion 37 is extracted from the female clutch portion 36 to thus disengage the clutch 35.

When the clutch 35 is disengaged as a result of deactivation of the detent 19, the torsion spring 42 is free to pivot the bolt 41 to the solid-line angular position of FIG. 3. The bolt 41 is then in the fully operative position. One of the purposes of the torsion spring 42 is to ensure that the bolt 41 can cover that angular distance which was covered by the bolt and element 34 during slight angular movement of the guide 16 and cylinder 12 relative to the case 18 during deactivation of the detent 19, namely while one of the follower surfaces 29 on each of the projections 21 was caused to slide along the adjacent ramp 30 at the time the spring 20 was in the process of storing energy due to combined axial and angular movements of the guide 16 relative to the case 18. The nature of engagement of the locking bolt 41 with a complementary part in a motor vehicle or the like is selected in such a way that the just described slight angular movement of the guide 16 and cylinder 12 relative to the case 18 during deactivation of the detent 19 does not suffice to actually open the lock 11. The extent of such angular movement of the cylinder 12, and hence of the element 34 and bolt 41 (during deactivation of the detent 19), can be selected by appropriate inclination of the ramps 30 and follower surfaces 29.

The projections 21 of the guide 16 can reenter the adjacent sockets 22 when the angular position of the cylinder 12 relative to the element 34 and bolt 41 (which latter is biased by the torsion spring 42 to the solid-line position of FIG. 3) is such that the male clutch portion 37 is free to enter the socket or depression of the female clutch portion 36 in order to reengage the clutch 35. Of course, the clutch portion 37 cannot enter the clutch portion 36 as long as the detent 19 remains deactivated. In other words, reengagement of the clutch 35 can be effected only by an authorized person having a key 14 which fits into the keyhole 13 of the cylinder 12 to thus enable such person to reactivate the detent 19.

An important advantage of the improved cylinder lock 11 is that the parts 21, 22 of the detent 19 are provided on components (case 18 and guide 16) which are necessary constituents of the lock, i.e., that the number of discrete parts is small. Another important advantage of the improved lock 11 is that it is more compact than heretofore known locks. Thus, the extent of necessary axial movability of the cylinder 12 and guide 16 is very limited so that the overall length of the case 18 (as seen in the axial direction of the cylinder) need not appreciably exceed the axial length of the guide 16 and/or the cylinder 12. A compact cylinder lock is desirable in numerous instances, for example, when used in automotive vehicles (but also in numerous other structures).

Compactness and simplicity of the improved cylinder lock 11 are further enhanced by the aforedescribed design of the clutch 35. This clutch need not employ any discrete parts because one of its portions is integral with the cylinder 12 and its other portion is integral with the motion transmitting element 34. This also contributes to lower cost and renders it possible to assemble the improved cylinder lock in an automatic machine. Furthermore, the clutch 35 does not contribute to the dimensions of the lock 11 because the male clutch portion 37 is fully received in the female clutch portion 36 (i.e., in the motion transmitting element 34) when the clutch is engaged. Therefore, the overall length of the lock 11 need not be increased on account of the clutch 35.

Compactness of the improved cylinder lock is further enhanced due to the fact that the collar 23 of the guide 16 is fully received in the internal recess 24 of the case 18, i.e., the radial dimensions of the case need not be increased on account of the provision of the collar 23 at the exterior of the guide. The face 28 constitutes the rear boundary of the recess 24 and performs the plural functions of serving (a) as an abutment for the collar 23, (b) as a part of the female portion of the detent 19, and (c) as a boundary for the rear axial end portion of the recess 24.

As already mentioned hereinbefore, the magnitude of torque which is required to deactivate the detent 19 can be selected within a wide range by the simple expedient of properly selecting the initial bias and the characteristics of the coil spring 20 and/or by appropriate selection of the inclination of ramps 30 and follower surfaces 29 relative to the common axis of the cylinder 12, guide 16 and motion transmitting element 34 and/or the height of the projections 21 and the depth of the sockets 22 as measured in the axial direction of the cylinder 12). The dimensions of the lock 11 need not be increased due to the provision of the spring 20 because the latter can be readily confined in the recess 24 adjacent that side of the collar 23 which faces away from the faces 27 and 28. Confinement of the spring 20 in the recess 24 ensures that this spring is invariably in an optimum position relative to the collar 23 and can propel the projections 21 into the adjacent sockets 22 as soon as the guide 16 reaches an angular position in which the projections can find their way into the adjacent sockets as a result of biasing of the guide 16 in a direction toward the face 28 of the case 18.

The key 14 is insertable into and withdrawable from the keyhole 13 at the front axial end 31 of the cylinder 12.

Figure 10:
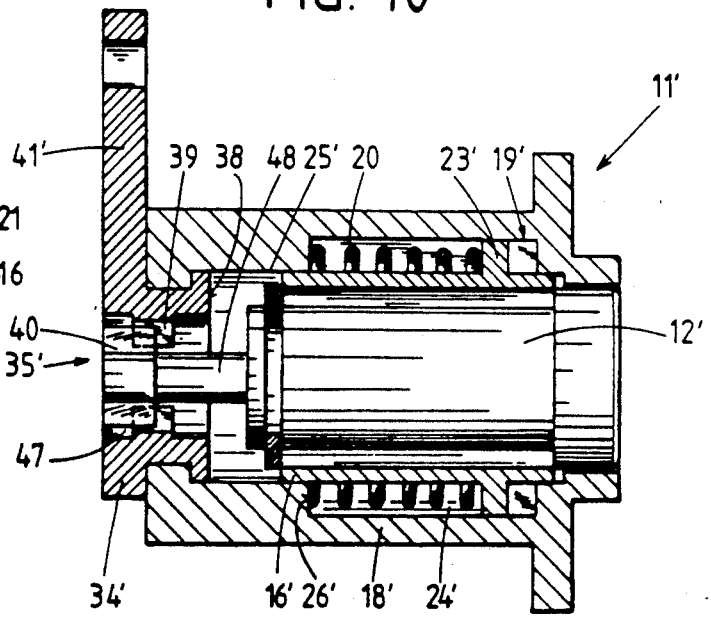
FIG. 10 is an axial sectional view of a modified cylinder lock, the detent being shown in the operative position and the clutch being shown in the engaged condition.
Figure 11:
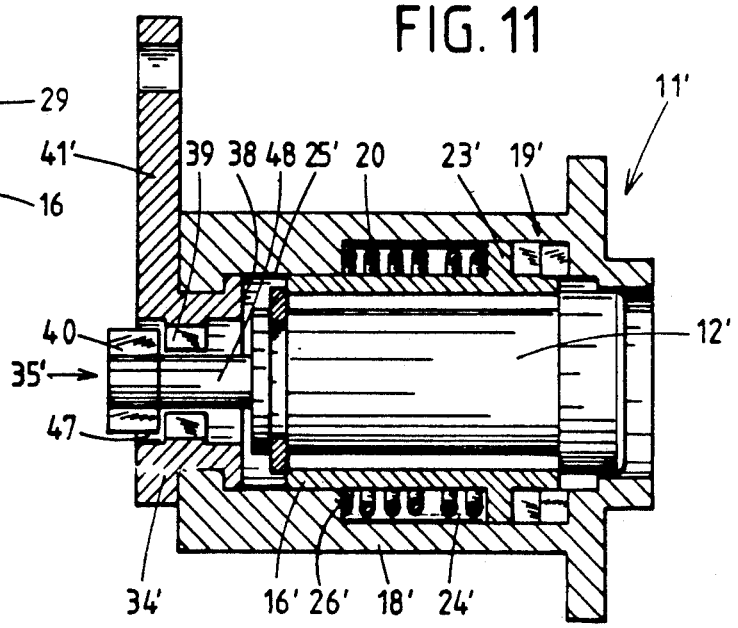
FIG. 11 shows the structure of FIG. 10 but with the detent in the inoperative position and the clutch in disengaged condition.

FIGS. 10 and 11 illustrate a modified cylinder lock 11' wherein the external collar 23' of the sleeve-like tubular guide 16' is located at the front end of the case 18'. The coil spring 20 of the detent 19' reacts against the internal shoulder 26' of the case 18' and bears against that side of the collar 23' which faces away from the projection(s) and socket(s) (not specifically shown) of the detent 19'. As in the cylinder lock 11 of FIGS. 1 to 9, the spring 20 of the detent 19' is confined in the cylindrical recess 24' which is machined into or is otherwise formed in the internal surface 25' of the case 18'. Since the detent 19' is located at the front end of the case 18', the cylinder 12' and the guide 16' must move axially away from the front end of the case 18' in order to deactivate the detent. This, in turn, necessitates the provision of a modified clutch 35' between the motion transmitting element 34' and the rear axial end of the cylinder 12'. The clutch 35' comprises a passage 47 which extends axially through the entire element 34' and contains one or more internal teeth or ribs 39 which are engaged by the complementary tooth or teeth 40 at the rear end of a shank 48 integral with the cylinder 12' and forming part of the male portion of the clutch 35'. The axial length of the shank 48 is selected in such a way that the clutch 35' is engaged (i.e., the motion transmitting element 34' must share all angular movements of the cylinder 12') when the detent 19' is operative, i.e., when the guide 16' and the cylinder 12' are free to assume their first or operative positions shown in of FIG. 10. On the other hand, the clutch 35' is disengaged (the tooth or teeth 40 are located behind and does or do not mesh with the tooth or teeth 39) when the detent 19' is inoperative because the spring 20 is caused to store energy as a result of expulsion of the projection(s) of the detent from the adjacent socket(s) (this is shown in FIG. 11). In all other respects, the operation of the cylinder lock 11' is identical with or is clearly analogous to that of the cylinder lock 11.

An important advantage of the cylinder lock 11' is that the strength of the clutch 35' can be selected practically at will. Thus, the clutch 35' can employ relatively long and strong teeth or ribs 39 or 40. FIGS. 10 and 11 further show that the locking bolt 41' can be made of one piece with the motion transmitting element 34'. This is equally possible in the cylinder lock 11 of FIGS. 1 to 9.

The improved cylinder lock is susceptible of numerous additional modifications without departing from the spirit of the invention. For example, the detent and/or the clutch can be modified as long as the clutch is disengaged not later than when the detent becomes inoperative. The number of projections forming part of the detent can be reduced to one or increased to more than two, and the biasing means of the detent can employ a package of dished springs and/or other suitable resilient element or elements other than coil springs.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A lock comprising a case having a first face; a tubular guide member axially movably and rotatably mounted in said case and having a second face confronting said first face; a cylinder member rotatably mounted in and sharing axial movements of said guide member and having a keyhole; at least one tumbler movably mounted in one of said members and normally engaging the other of said members to prevent rotation of said cylinder member in said guide member, said at least one tumbler being disengaged from said other member in response to insertion of a fitting key into said keyhole so that the inserted fitting key can rotate said cylinder member in said guide member; a detent including at least one projection provided on one of said faces, at least one socket provided in the other of said faces and means for biasing said at least one projection into said at least one socket axially of said guide member to thereby prevent rotation of said guide member in said case, said at least one projection being expelled from said at least one socket in response to the application to said guide member of a torque sufficient to turn said guide member with attendant axial movement of said guide member from a first position through a predetermined distance away from said first face and against the opposition of said biasing means to a second position; a motion transmitting element rotatably carried by said case; and means for rotating said element in response to rotation of said cylinder member in said first position but not in said second position of said guide member.

2. The lock of claim 1, wherein said motion transmitting element and said case comprise means for maintaining said element in a predetermined axial position relative to said case, and further comprising means for yieldably urging said at least one tumbler into engagement with said other member.

3. The lock of claim 1, wherein said first face includes an annular internal shoulder of said case and said second face includes an annular external shoulder of said guide member, said motion transmitting element being coaxial with said members and said shoulders being disposed in planes at least substantially normal to the common axis of said element and said members.

4. The lock of claim 1, further comprising means for limiting the axial movability of said members away from said first face.

5. The lock of claim 1, wherein said rotating means comprises a clutch having a first portion provided directly on said motion transmitting element and a second portion provided directly on said cylinder member and non-rotatably engaging with said first portion in the first position of said guide member.

6. The lock of claim 1, wherein said guide member comprises an external collar and said case has an internal surface provided with a substantially cylindrical recess for said collar, said first face being provided in said recess and said second face being provided on said collar.

7. The lock of claim 6, wherein said at least one projection is provided on said collar and said at least one socket is provided in said first face.

8. The lock of claim 6, wherein said biasing means is disposed in said recess and includes at least one resilient element reacting against said case and bearing against said collar.

9. The lock of claim 8, wherein said at least one resilient element is a coil spring and said collar has a side which is located opposite said second face and is engaged by said spring.

10. The lock of claim 8, wherein said recess has a first axial end and a second axial end, said first face being provided at one of said axial ends and said at least one resilient element reacting against said case at the other of said axial ends.

11. The lock of claim 6, wherein said recess has a first axial end at and a second axial end remote from said first face.

12. The lock of claim 11, wherein said case has a rear end nearer to and a front end more distant from said first face.

13. The lock of claim 11, wherein said case has a rear end more distant from and a front end nearer to said first face.

14. The lock of claim 1, wherein said other face has two ramps which are inclined relative to the axis of said guide member and flank said at least one socket, said at least one projection having two follower surfaces which are adjacent said ramps in the first position of said guide member and one of which slides along the respective ramp or vice versa in response to the application of said sufficient torque to thus compel said members to move axially and away from said first face.

15. The lock of claim 1, wherein said rotating means includes a male clutch portion having an at least partially non-circular cross-sectional outline and a complementary female clutch portion, one of said clutch portions being rotatable with said cylinder member and the other of said clutch portions being rotatable with said motion transmitting element.

16. The lock of claim 15, wherein said motion transmitting element has a surface confronting said cylinder member, said female clutch portion has a socket in said surface of said element.

17. The lock of claim 15, wherein said female clutch portion includes a through passage in said motion transmitting element.

18. The lock of claim 15, wherein said male clutch portion comprises a shank rigid with said cylinder member and extending into said female clutch portion at least in the first position of said guide member.

* * * * *